US010304414B2

(12) United States Patent
Bargh et al.

(10) Patent No.: US 10,304,414 B2
(45) Date of Patent: May 28, 2019

(54) METHODS OF INTEGRITY CHECKING DIGITALLY DISPLAYED DATA AND DISPLAY SYSTEM

(71) Applicant: GE Aviation Systems Limited, Cheltenham, Gloucestershire (GB)

(72) Inventors: Roger Anthony Bargh, Cheltenham (GB); Timothy John Roberts, Cheltenham (GB); Michael Paul Jenkins, Shanghai (CN); William James Davidson, Cheltenham (GB); Michael John Allen, Cheltenham (GB); Damian Francis Minihan, Cheltenham (GB); Timothy George Riley, Cheltenham (GB); Steven Anthony Martin, Cheltenham (GB); Gary Quelcuti, Cheltenham (GB); Mark Andrew Paul Edwards, Cheltenham (GB)

(73) Assignee: GE Aviation Systems Limited, Cheltenham (GB)

( * ) Notice: Subject to any disclaimer, the term of this patent is extended or adjusted under 35 U.S.C. 154(b) by 0 days.

(21) Appl. No.: 14/845,444

(22) Filed: Sep. 4, 2015

(65) Prior Publication Data

US 2016/0071231 A1 Mar. 10, 2016

(30) Foreign Application Priority Data

Sep. 5, 2014 (GB) ..... 1415700.2

(51) Int. Cl.
*G09G 5/36* (2006.01)

(52) U.S. Cl.
CPC ..... *G09G 5/36* (2013.01); *G09G 2330/12* (2013.01); *G09G 2380/12* (2013.01)

(58) Field of Classification Search
None
See application file for complete search history.

(56) References Cited

U.S. PATENT DOCUMENTS

2003/0185446 A1* 10/2003 Huang ..... G06T 15/00 382/218
2005/0276514 A1* 12/2005 Fisher ..... G06T 7/001 382/286

(Continued)

FOREIGN PATENT DOCUMENTS

EP 1 757 906 A2 2/2007
EP 2 254 039 A1 11/2010

(Continued)

OTHER PUBLICATIONS

Combined Search and Examination Report issued in connection with corresponding GB application 1415700.2, dated Mar. 16, 2015.

(Continued)

*Primary Examiner* — Xiao M Wu
*Assistant Examiner* — Steven Z Elbinger
(74) *Attorney, Agent, or Firm* — Amin, Turocy & Watson, LLP

(57) ABSTRACT

Methods of integrity checking digitally displayed data in a display system having a display comprising a pixel array and a display system having a CPU configured to output data, a display screen comprising a pixel array with viewable and non-viewable areas, a GPU configured to receive the outputted data from the CPU and graphically render the information on the viewable area of the display screen, and a GIM engine configured to determine the integrity of drawn graphical information.

20 Claims, 5 Drawing Sheets

(56) References Cited

U.S. PATENT DOCUMENTS

| | | | | |
|---|---|---|---|---|
| 2006/0212753 | A1* | 9/2006 | Sato | G06F 1/28 714/12 |
| 2007/0002053 | A1* | 1/2007 | Hill | G06T 15/005 345/443 |
| 2007/0013693 | A1* | 1/2007 | Hedrick | G01C 23/005 345/419 |
| 2007/0046670 | A1 | 3/2007 | Hedrick | |
| 2007/0206018 | A1* | 9/2007 | Bajic | G06F 1/3225 345/501 |
| 2008/0024665 | A1* | 1/2008 | Nakoji | H04H 40/27 348/558 |
| 2012/0098842 | A1 | 4/2012 | Manz et al. | |
| 2014/0085324 | A1* | 3/2014 | Charvet | G06T 7/0004 345/589 |
| 2015/0062139 | A1* | 3/2015 | Akenine-Moller | G06T 1/60 345/555 |
| 2015/0339188 | A1* | 11/2015 | Hu | G06F 11/1072 714/704 |

FOREIGN PATENT DOCUMENTS

| | | | |
|---|---|---|---|
| EP | 1757906 | B1 | 12/2011 |
| EP | 2254039 | A1 | 12/2012 |
| WO | 2000014714 | A1 | 3/2000 |

OTHER PUBLICATIONS

French Search Report and Written Opinion issued in connection with corresponding FR Application No. 1558182 dated Jul. 30, 2018.

* cited by examiner

METHODS OF INTEGRITY CHECKING DIGITALLY DISPLAYED DATA AND DISPLAY SYSTEM

BACKGROUND OF THE INVENTION

Contemporary aircraft may include displays for displaying graphical information to a user. The contemporary aircraft may utilize monitoring where the correctness of the graphical display is determined by selecting real outputs and reverse processing them back into their original input form to be compared against current inputs. Active display monitoring is a costly technique.

BRIEF DESCRIPTION OF THE INVENTION

In one embodiment, the invention relates to a method of integrity checking digitally displayed data in a display system having a display comprising a pixel array with viewable and non-viewable areas, the method includes drawing predetermined graphical information to the non-viewable area of the pixel array, comparing the drawn graphical information to a corresponding signature reference for the graphical information, and determining the integrity of the drawn graphical information based on the comparison.

In one embodiment, the invention relates to a method of integrity checking digitally displayed data in a display system having a display comprising a pixel array with a viewable area, the method includes drawing graphical information to the viewable area of the pixel array, comparing the drawn graphical information to a corresponding signature reference for the graphical information, and determining the integrity of the drawn graphical information based on the comparison.

In one embodiment, the invention relates to a display system having a CPU configured to output data, a display screen comprising a pixel array with viewable and non-viewable areas, a GPU configured to receive the outputted data from the CPU and graphically render the information on the viewable area of the display screen, and a (graphics integrity monitor) GIM engine configured to compare drawn graphical information to a corresponding signature reference for the graphical information, and determine the integrity of the drawn graphical information based on the comparison.

DETAILED DESCRIPTION OF THE INVENTION

Figure 1:
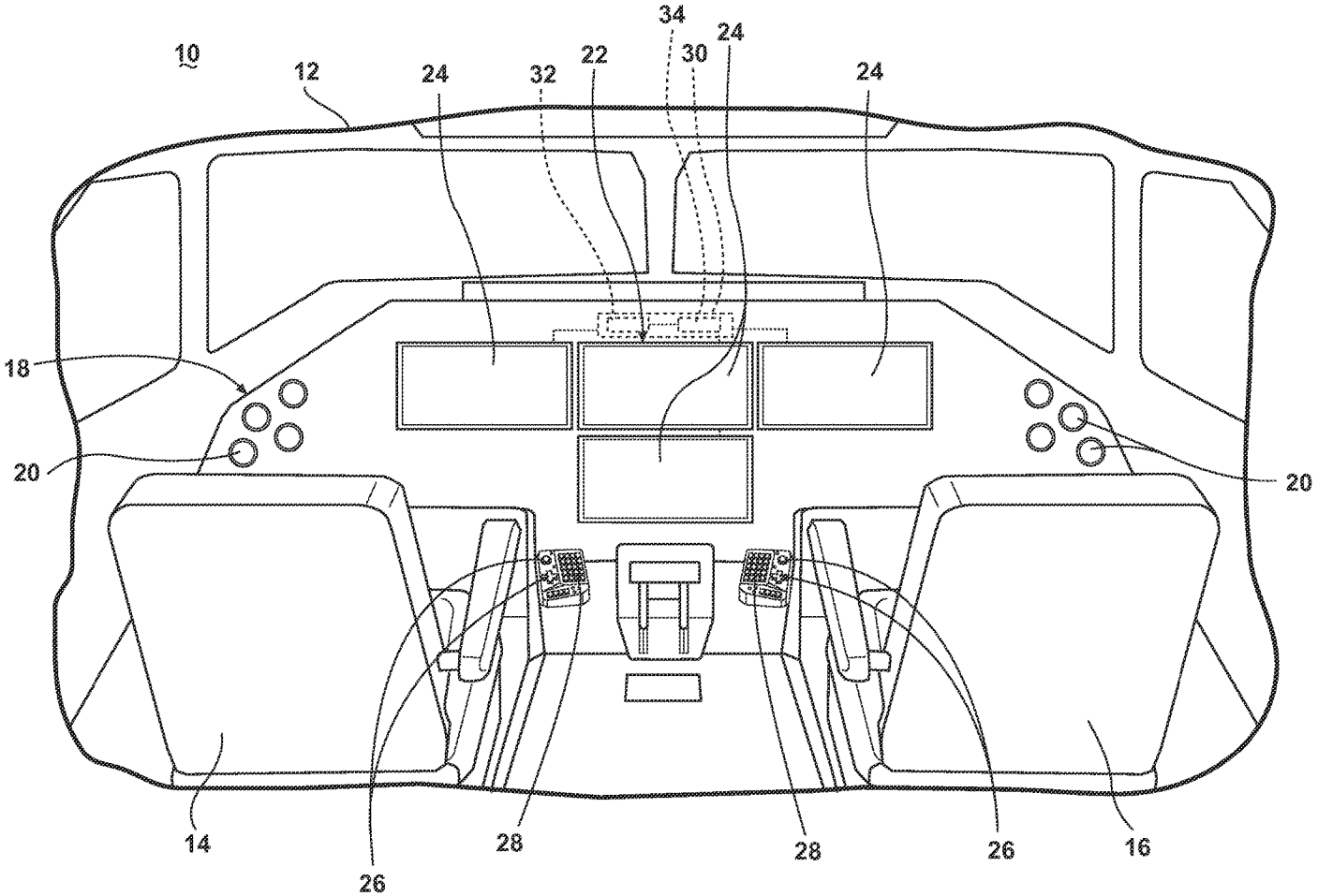
FIG. 1 is a perspective view of a portion of a cockpit including a display system according to an embodiment of the invention.

FIG. 1 illustrates a portion of an aircraft 10 having a cockpit 12. While a commercial aircraft has been illustrated, it is contemplated that embodiments of the invention may be used in any type of legacy aircraft, for example, without limitation, fixed-wing, rotating-wing, rocket, personal aircraft, and military aircraft. A first user (e.g., a pilot) may be present in a seat 14 at the left side of the cockpit 12 and another user (e.g., a co-pilot) may be present at the right side of the cockpit 12 in a seat 16. A flight deck 18 having various instruments 20 and a display system 22, which has been illustrated as having multiple multifunction flight displays 24 that may be located in front of the pilot and co-pilot and may provide the flight crew with information to aid in flying the aircraft 10.

The flight displays 24 may include either primary flight displays or multi-function displays and may display a wide range of aircraft, flight, navigation, and other information used in the operation and control of the aircraft 10. The flight displays 24 may be capable of displaying color graphics and text to a user. The flight displays 24 may be laid out in any manner including having fewer or more displays and need not be coplanar or the same size. A touch screen display or touch screen surface may be included in the flight display 24 and may be used by one or more flight crewmembers, including the pilot and co-pilot, to interact with the systems of the aircraft 10. Further, one or more cursor control devices 26, such as a mouse, and one or more multifunction keyboards 28 may be included in the cockpit 12 and may also be used by one or more flight crew members to interact with the systems of the aircraft 10.

A controller 30 may be operably coupled to components of the aircraft 10 including the flight displays 24, cursor control devices 26, and keyboards 28. The controller 30 may include, among other things, a memory 32 and a processor 34. The memory 32 may include random access memory (RAM), read-only memory (ROM), flash memory, or one or more different types of portable electronic memory, such as discs, DVDs, CD-ROMs, etc., or any suitable combination of these types of memory. The processor 34 may be running any suitable programs to implement a graphical user interface (GUI) and operating system. In an embodiment, these programs include a device driver that allows the user to perform functions such as selecting options, inputting commands and other data, selecting and opening files, and moving icons. The controller 30 may be a portion of an FMS or may be operably coupled to the FMS.

A computer searchable database of information may be stored in the memory 32 and accessible by processor 34. The processor 34 may run a set of executable instructions to display the database or access the database. Alternatively, the controller 30 may be operably coupled to a database of information. For example, such a database may be stored on an alternative computer or controller. It will be understood that the database may be any suitable database, including a single database having multiple sets of data, multiple discrete databases linked together, or even a simple table of data. The controller 30 may also be connected with other controllers (not shown) of the aircraft 10.

Figure 2:
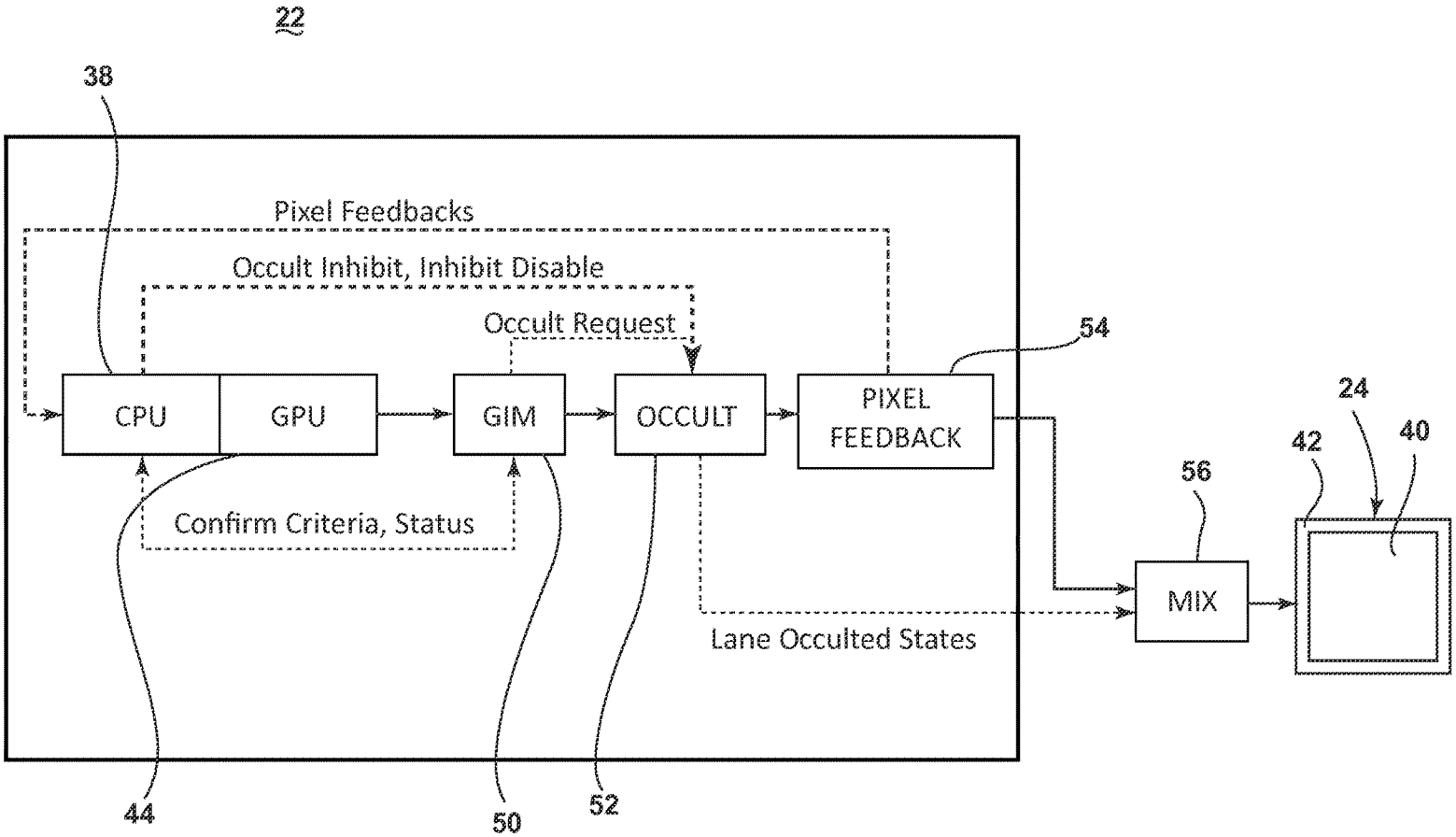
FIG. 2 is a schematic illustration of an exemplary display system according to an embodiment of the invention.

FIG. 2 schematically illustrates an exemplary display system 22 that may be utilized in the aircraft 10. A CPU 38 configured to output data may be included in the display system 22. The CPU 38 may be any suitable processor, general or specific designed for the task, including that the CPU 38 may be the controller 30 or may be a portion of the controller 30. The display screen 24 may include a pixel array with a viewable area 40 and a non-viewable area 42. A graphics processor unit (GPU) 44 may also be included and the GPU 44 may be configured to receive the outputted data from the CPU 38 and graphically render the information on the viewable area 40 of the display screen 24. While the GPU 44 has been illustrated as being separate from the CPU 38 it will be understood that alternatively the GPU 44 may a portion of the CPU 38. For example, the GPU 44 may be software on the CPU 38. Further, a graphics integrity monitor (GIM) may include a variety of components including GIM engine(s) 50. The GIM components of the computer program in the CPU 38 may be configured to draw predetermined graphical information to the non-viewable area 42 of the pixel array of the display screen 24 and/or draw graphical information to the viewable area 40 of the pixel array of the display screen 24. The GIM engine 50 may be configured to compare the drawn graphical information to a corresponding signature reference for the graphical information and determine the integrity of the drawn graphical information based on the comparison. This may include that the GIM engine 50 may be configured to analyze the actual graphical information drawn against an expected signature reference for the graphical information. The GIM engine 50 may also be configured to check the integrity of the display memory, which may include the memory 32 or a separate memory, the GPU 44, the CPU 38, and any software components for the display system 22. The GIM engine 50 may feed into an occult 52 and pixel feedback 54 as well as a mixer 56, which may in turn provide information to the display screen 24.

During operation, the CPU 38 and GPU 44 produce various graphical displays on the display screen(s) 24. For example, a computer program running on the CPU 38 may define areas of the display screen(s) 24 to be monitored and checked by the GIM engine 50. The area definitions may be supplied directly to the GIM engine 50 or via non-visible data within the display screen 24 itself. This information includes the position and size of rectangular areas of the display screen(s) 24 and unique signatures that represent the pixel content of the rectangular areas. The unique signatures may be Cyclic Redundancy Check (CRC) values computed by a computer program to predict the content of the rectangular areas. In each display area, the GIM engine 50 reads the checking information and uses it to retrieve the rectangular areas pixel content and calculate its own CRC values. It will be understood that the display itself 24 is not checked rather it is the stream of pixels that will be displayed on the display 24 that the GIM engine 50 is monitoring and may be getting occulted, mixed and then displayed on the display 24. The retrieval may be by reads from the display buffer, buffer or area capture, or the CRC may be formed by reading data on the fly as it is scanned out. These CRCs are checked against those predicted.

The GIM engine 50 feeds the active pixel stream through the occult 52, pixel feedback 54, and mixer 56 onto the display screen 24. The occult 52 may blank or set to black all the pixels in the active pixel stream dependent on the occult request signal from the GIM engine 50, thus removing display information normally produced by this lane. Alternatively the GIM engine may blank or mark as a warning the pixels relating to the GIM area being checked. The pixel feedback 54 may be used to test that the occult and blanking mechanisms work correctly.

The graphics to be displayed in the rectangular areas or their positions are not constrained and thus the GIM engine 50 may be used to also check the integrity of various portions of the display system 22. The GIM engine 50 aids in assuring the integrity of the information displayed and may be configured to blank the display screen(s) 24 if the displayed data integrity is deemed to be suspect. The GIM engine 50 may also be configured to provide an alert regarding a failure of a check.

Figure 3:
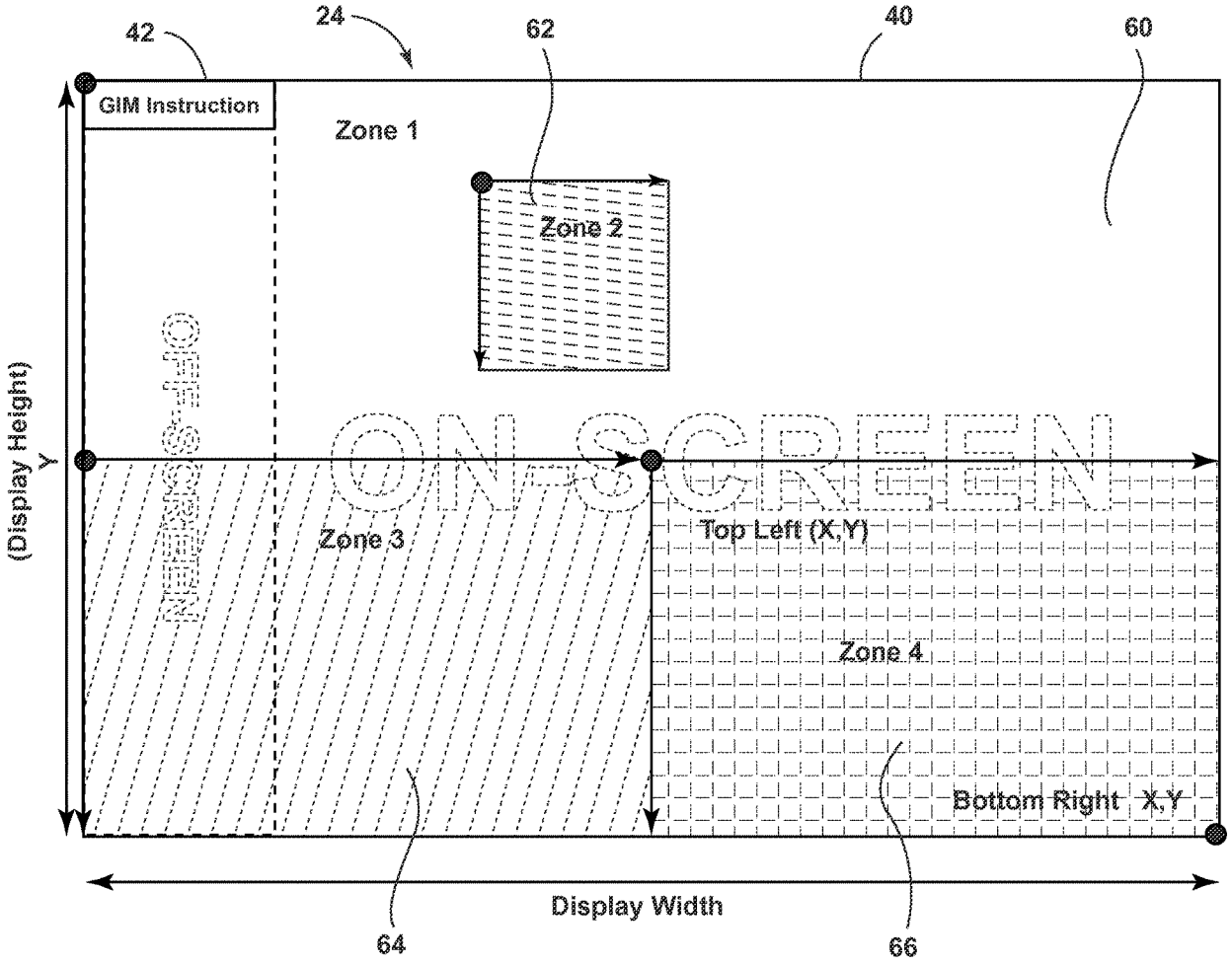
FIG. 3 is a schematic illustration of a display screen having viewable and non-viewable areas, which may be used in the display system of FIG. 2.

FIG. 3 illustrates some of the areas that may be defined on the display screen(s) 24. A computer program running on the CPU 38 may define areas of the display screen(s) 24 to be monitored and checked by the GIM engine 50 including zone 1 indicated at 60, zone 2 indicated at 62, zone 3 indicated at 64 and zone 4 indicated at 66. It will be understood that the zones are the areas of the display 24 as they appear in the frame buffer within the memory 32 of the CPU/GPU. This may be streamed through the GIM engine 50 or read directly by the GIM engine 50, which gets the GIM instruction and checks the integrity. The Off screen area is either not sent out of the GPU 44 or is cropped when passing through the GIM engine 50. This off screen information will not be present post GIM engine 50 so will not be on the display 24. This information includes the position and size of rectangular areas of the display screen, and unique signatures that represent the pixel content of the said rectangular areas. Further, it will be understood that such zones are merely for exemplary purposes and the areas may be any size rectangle on screen, off screen, or spanning both.

The non-viewable area 42 may be output by the GPU 44 into the pixel stream. It will be understood that such a non-viewable area is not visible on the final display screen 24 instead it is cropped by the GIM engine 50 or mixer 56. It is contemplated that this non-viewable area 42 may be defined into areas for various usage by the GIM engine 50. The non-viewable area 42 may be any suitable size wide and the height of the particular display screen 24. While FIG. 3 illustrates the non-viewable area 42 as being along one side it is contemplated that the non-viewable area 42 may be any size and configuration including that it may be a peripheral area behind the trim bezel of the display screen 24. The operation of the GIM engine 50 may be invisible to the observer of the display screen 24. Including that, the defined display areas to be checked may be outside the viewable area 40 but may still be part of the pixel stream output from the GPU 44. The viewable area 40 is usually the physical area output by the GPU 44. To provide an invisible area or non-viewable area 42, the physical area may be made wider than the visible area viewable area 40 (as far as the GPU 44 is concerned). The GIM engine 50 or the mixer 56 is then responsible for passing only the visible area through for display on the display screen 24.

The graphics drawn must be predictable. The GIM engine 50 may capture rectangular pixel data from any area of the graphics output stream defined by inputs top left and bottom right x, y and calculate a signature reference (for example CRC) for the enclosed pixels. The signature references are output by the GIM engine 50 and checked against the predicted values supplied. The GIM engine 50 performs checks against the predicted signature references for the combined pixels data. The graphics pixel areas that are involved in the GIM checks are not to be interacted with by other unpredictable graphical elements. This is necessary to be able to predict the signature references without having to consider infraction of variable background items such as video and/or elements that move within the monitored areas. It may also be understood that there may be a number of GIMs that run concurrently, examining the pixel output stream of each GPU to defined areas of the output frame buffer display. The defined areas, predicted signature references and pass/fail criteria definitions may all be supplied to the GIM via the frame buffer pixel output stream itself in the first line of the off-screen area. The GIM engine 50 may be oblivious to the use of the area of the display it checks, it could be on-screen or off-screen and is entirely defined by the positions supplied to each GIM engine 50.

For the basic assurance, the GIM engine 50 may be hardware configured to occult the particular display stream if a confirmed failure is detected. For the general purpose, the GIM engine 50 may be hardware configured to either occult the stream on failure or not. For any GIM type, the GIM engine 50 may report status back to the software for fails, confirmed fails and occult state. Nuisance shutdowns are to be avoided by confirming a fault, either by repeating the test or counting a number of occurrences. The confirm criteria parameters may be N and X where N is the number of fail detections in X refresh frames before the fault is confirmed and the GIM engine 50 makes its defined response. If there are no fails detected in X frames then the fault is deemed no longer present.

It will be understood that details of environments that may implement embodiments of the invention are set forth in order to provide a thorough understanding of the technology described herein. It will be evident to one skilled in the art, however, that the exemplary embodiments may be practiced without these specific details and in alternative manners. The exemplary embodiments are described with reference to the drawings. These drawings illustrate certain details of specific embodiments that implement a module or method, or computer program product described herein. However, the drawings should not be construed as imposing any limitations that may be present in the drawings. The method and computer program product may be provided on any machine-readable media for accomplishing their operations. The embodiments may be implemented using an existing computer processor, or by a special purpose computer processor incorporated for this or another purpose, or by a hardwired system.

As noted above, embodiments described herein may include a computer program product comprising machine-readable media for carrying or having machine-executable instructions or data structures stored thereon. Such machine-readable media may be any available media, which may be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium that may be used to carry or store desired program code in the form of machine-executable instructions or data structures and that may be accessed by a general purpose or special purpose computer or other machine with a processor. When information is transferred or provided over a network or another communication connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data, which cause a general-purpose computer, special purpose computer, or special purpose processing machines to perform a certain function or group of functions.

Embodiments will be described in the general context of method steps that may be implemented in one embodiment by a program product including machine-executable instructions, such as program codes, for example, in the form of program modules executed by machines in networked environments. Generally, program modules include routines, programs, objects, components, data structures, etc. that have the technical effect of performing particular tasks or implement particular abstract data types. Machine-executable instructions, associated data structures, and program modules represent examples of program codes for executing steps of the method disclosed herein. The particular sequence of such executable instructions or associated data structures represent examples of corresponding acts for implementing the functions described in such steps.

Embodiments may also be practiced in distributed computing environments where tasks are performed by local and remote processing devices that are linked (either by hardwired links, wireless links, or by a combination of hardwired or wireless links) through a communication network. In a distributed computing environment, program modules may be located in both local and remote memory storage devices. The above representation is merely for context and it will be understood that the GIM engine 50 may be utilized in any suitable manner. For example, it is contemplated that a sumcheck or other signature method may be used. Further, the off-screen area could be a separate buffer. Further still, it will be understood that another CPU could be used as a checker rather than the checking being performed in hardware.

Figure 4:
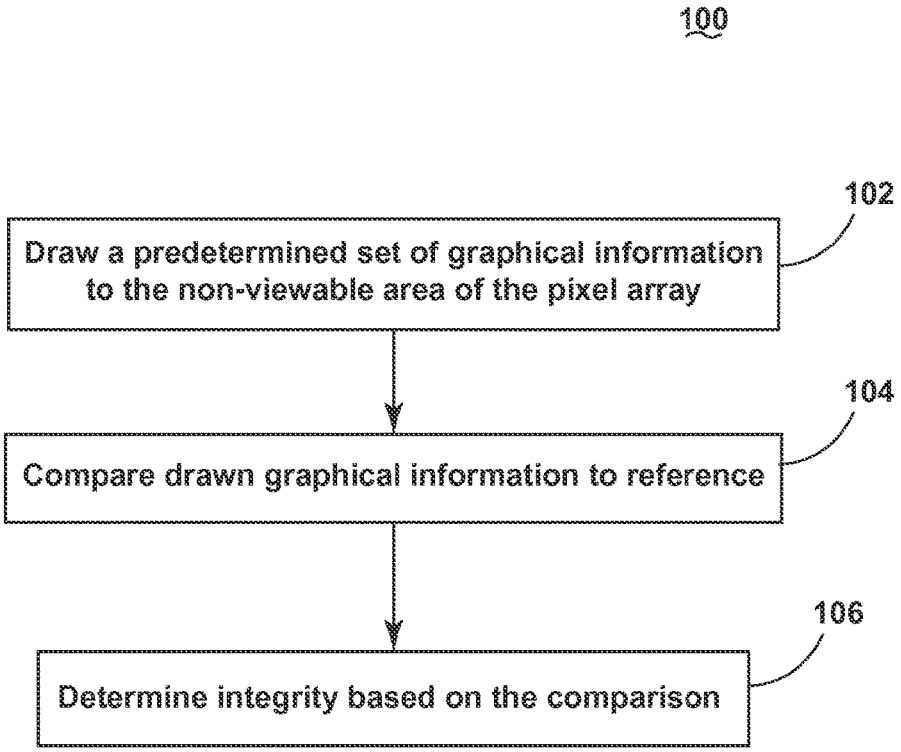
FIG. 4 is a flowchart showing a method of integrity checking data drawn to a non-viewable area according to an embodiment of the invention.

In accordance with an embodiment of the invention, FIG. 4 illustrates a method 100, which may be used for integrity checking digitally displayed data in a display system, such as the display system 22 or any display system having a display comprising a pixel array with viewable and non-viewable areas. The method 100 begins at 102 by drawing predetermined graphical information to the non-viewable area of the pixel array. At 104, the drawn graphical information may be compared to a corresponding signature reference for the graphical information and at 106, the integrity of the drawn graphical information may be determined based on the comparison.

A full example may prove useful. For example, at 102, the predetermined graphics may include any suitable graphics that may allow the integrity of the display system 22 to be checked. For example, the predetermined graphical information may include at least one non-application specific graphical primitive drawn into the non-viewable area. By way of non-limiting examples, such graphical primitives may include a line, circle, rectangle, and/or triangle. Alternatively, the graphical primitives may include non-geometrical shapes. At 104, the comparing comprises signature checking the drawn predetermined graphical primitive against signature reference values and, at 106, the integrity of the drawn graphical information may be determined based on the comparison. For example, such a monitoring approach may check the functionality of the GPU 44 by drawing all non-application specific graphical primitives into an off-screen area or non-viewable area 42 of the display screen 24. These may then be signature checked by the GIM engine 50 against known values, such as those supplied by software. This method decouples the checking of the display system 22 from any dependence on the formats and graphical features of an application display.

Another non-limiting example includes where the GIM components draw, at 102, a predetermined graphical information that include static versions of the on-screen critical display parameters drawn into the non-viewable area 42. The drawing of the predetermined graphical information may be to scale of the viewable critical display parameters. The static versions of the on-screen critical display parameters may include sequences of on-screen display symbology. For example, a scale that normally displays from 0 to 100 on screen would be drawn off-screen at say 0, 10, 20, 50, 100 in sequence in order to determine that the normal display infrastructure is working correctly. When the graphical information includes static versions, the comparing, at 104, may include comparing the static versions to predetermined signature reference values. In this manner, the GIM components may utilize standardized drawing routines to draw off-screen static versions of the on-screen critical display parameters, which are then checked against known signatures. This monitoring approach has advantages in not having to adjust the monitoring, dependent on applications displays unless the routine itself is changed.

It will be understood that the method 100 of integrity checking digitally displayed data in a display system is flexible and the method 100 illustrated is merely for illustrative purposes. For example, the sequence of steps depicted is for illustrative purposes only, and is not meant to limit the method 100 in any way, as it is understood that the steps may proceed in a different logical order or additional or intervening steps may be included without detracting from embodiments of the invention. By way of non-limiting example, while the drawing, comparing, and determining has been described as being performed by the GIM components, the method may be performed by any suitable combination of hardware and software.

Figure 5:
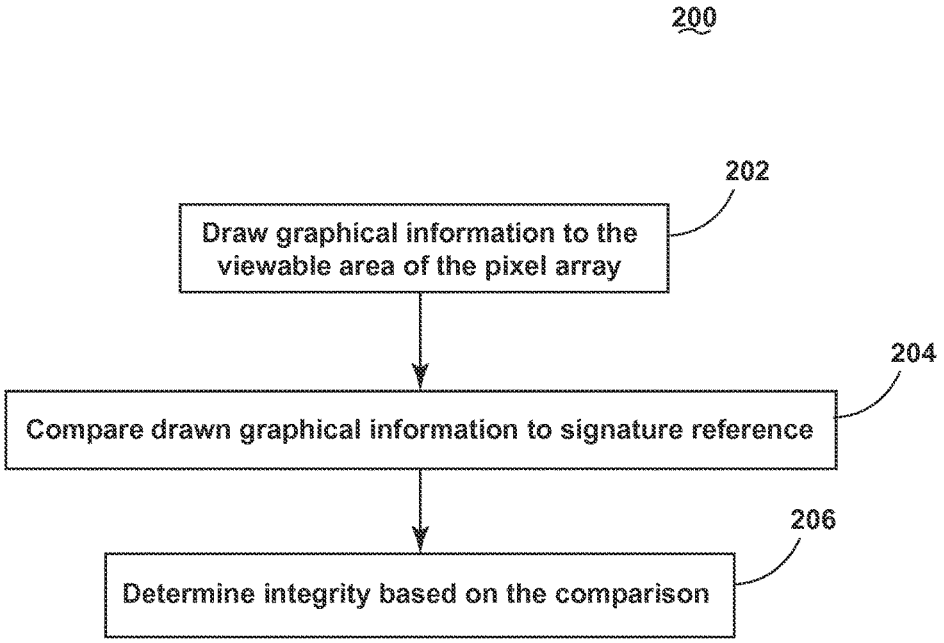
FIG. 5 is a flowchart showing a method of integrity checking data drawn to a viewable area according to an embodiment of the invention.

It is also contemplated that the GIM components may not have to draw predetermined graphical information to the non-viewable area of the pixel array to check the display system 22. In accordance with an embodiment of the invention, FIG. 5 illustrates a method 200, which may be used for integrity checking digitally displayed data in a display system, such as the display system 22 or any display system having a display with a pixel array with a viewable area 40. The method 200 begins at 202 by drawing predetermined graphical information to the viewable area 40 of the pixel array of the display screen 24. At 204, the drawn graphical information may be compared to a corresponding signature reference for the graphical information. For example, the signature reference may be a pre-calculated value supplied by software. At 206, the integrity of the drawn graphical information may be determined based on the comparison. This monitoring approach checks for correct displays by signature checking actual display items against pre-calculated values supplied by software.

Technical effects of the above-described embodiments include that digitally displayed data may be checked for integrity, which provides a variety of benefits including that the above embodiments facilitate integrity checking of digital display system types that use pixel format displays. The above-described embodiments may monitor correctness of a graphical primitive set, correctness of facsimiles of the actual displayed data, or correctness of the actual displayed data itself. Further, the above-described embodiments may include that a failure of a check may be displayed and that the display may be optionally blanked. The above-described embodiments provide for a simpler approach than reading back display data.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A display system, comprising:

a display screen comprising a pixel array with viewable and non-viewable areas;

a Central Processing Unit (CPU) configured to:

output graphical information for presentation within at least a portion of the pixel array, and define an area of the at least the portion of the pixel array for integrity monitoring that does not have any moving graphical content;

and a Graphics Processing Unit (GPU) configured to receive the outputted graphical information from the CPU and graphically render the graphical information, via a Graphics Integrity Monitor (GIM) engine, on the display screen, wherein the GIM engine is configured to:

determine an integrity of a portion of a stream of pixels generated by the GPU based on the graphical information that will be displayed on the display screen in the defined area, based on a comparison of a signature of the portion of the stream of pixels to a corresponding signature reference for a portion of the graphical information that will be displayed on the display screen in the defined area, and in response to determining that the integrity is failed and that there are no fails detected in a predetermined number of refresh frames following the determination that the integrity is failed, determining that the integrity is no longer failed and preventing initiation of a hardware driven occult of the pixel stream on the display screen.

2. The display system of claim 1 wherein the GIM engine is further configured to check the integrity of the display memory, the GPU, the CPU, and software components.

3. The display system of claim 1 wherein the GIM engine is further configured to provide an alert in response to a determination that the integrity is failed.

4. The display system of claim 3 wherein the GIM engine is further configured to confirm a failure of the integrity by at least one of repetition of the comparison or a determination of a number of occurrences of the failure.

5. The display system of claim 4 wherein the confirmation includes a count of a predetermined number of fail detections in a predetermined number of refresh frames.

6. The display system of claim 1 wherein the GIM engine is further configured to blank the display or portions of the display.

7. The display system of claim 1 wherein the GPU is implemented in software on the CPU.

8. A method, comprising:

defining, by a Central Processing Unit (CPU), an area of a display screen for integrity monitoring that does not have any moving graphical content;

outputting, by a Graphics Processing Unit (GPU), a pixel stream to be displayed on the display screen, wherein the pixel stream corresponds to graphical information output by the CPU for presentation on the display screen; and checking, via an independent Graphics Integrity Monitor (GIM) downstream of the Graphics Processing Unit, integrity of the pixel stream, including comparing a signature of a portion the pixel stream that will be display in the defined area against an expected signature reference for a portion of the graphical information that will be displayed on the display screen in the defined area, determining an integrity of the pixel stream based on the comparison, and in response to determining that the integrity is failed and that there are no fails detected in a predetermined number of refresh frames following the determination that the integrity is failed, determining that the integrity is no longer failed and preventing initiation of a hardware driven occult of the pixel stream on the display screen.

9. The method of claim 8, further comprising providing an alert in response to a determination that the integrity is failed.

10. The method of claim 8, wherein the Graphics Processing Unit is executing as part of the Central Processing Unit.

11. The method of claim 8, further comprising blanking, by the Graphics Integrity Monitor, one or more portions of the display screen.

12. The method of claim 8, wherein the pixel stream includes a viewable and non-viewable area.

13. The method of claim 12, wherein the non-viewable area is cropped by the Graphics Integrity Monitor prior to display.

14. The method of claim 8, further comprising blanking or marking as a warning, by the Graphics Integrity Monitor, one or more pixels determined to fail the integrity.

15. The method of claim 8, further comprising confirming a failure of the integrity including at least one of repeating the comparison or counting a number of occurrences of the failure.

16. The method of claim 8, wherein the confirming includes determining a predetermined number of fail detections in a predetermined number of refresh frames.

17. A non-transitory computer-readable medium having instructions stored thereon that, in response to execution, cause a system including a processor to perform operations comprising:

defining, by a Central Processing Unit (CPU), an area of a display screen for integrity monitoring that does not have any moving graphical content;

outputting, by a Graphics Processing Unit (GPU), a pixel stream to be displayed on the display screen, wherein the pixel stream corresponds to graphical information output by the CPU for presentation on the display screen; and checking, via an independent Graphics Integrity Monitor (GIM) downstream of the Graphics Processing Unit, integrity of the pixel stream, including comparing a signature of a portion the pixel stream that will be display in the defined area against an expected signature reference for a portion of the graphical information that will be displayed on the display screen in the defined area, determining an integrity of the pixel stream based on the comparison, and in response to determining that the integrity is failed and that there are no fails detected in a predetermined number of refresh frames following the determination that the integrity is failed, determining that the integrity is no longer failed and preventing initiation of a hardware driven occult of the pixel stream on the display screen.

18. The non-transitory computer-readable medium of claim 17, the operations further comprising providing an alert in response to a determination that the integrity is failed.

19. The non-transitory computer-readable medium of claim 17, the operations further comprising blanking or marking as a warning, by the Graphics Integrity Monitor, one or more pixels determined to fail the integrity.

20. The non-transitory computer-readable medium of claim 17, the operations further comprising confirming a failure of the integrity including at least one of repeating the comparison or counting a number of occurrences of the failure.

* * * * *